United States Patent [19]

Aoki

[11] Patent Number: 4,806,714

[45] Date of Patent: Feb. 21, 1989

[54] ELECTRODE STRUCTURE FOR VACUUM CIRCUIT BREAKER

[75] Inventor: Shin-ichi Aoki, Amagasaki, Japan

[73] Assignee: Mitsubishi Denki Kabushiki Kaisha, Japan

[21] Appl. No.: 101,433

[22] Filed: Sep. 28, 1987

[30] Foreign Application Priority Data

Sep. 30, 1986 [JP] Japan ..... 61-233577

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,711,665 | 1/1973 | Dethlefsen | 200/144 B |
| 3,845,262 | 10/1974 | Hundstad | 200/144 B |
| 4,210,790 | 7/1980 | Kurosawa et al. | 200/144 B |
| 4,324,960 | 4/1982 | Aoki et al. | 200/144 B |

FOREIGN PATENT DOCUMENTS

| | | | |
|---|---|---|---|
| 55-30174 | 3/1980 | Japan . | |
| 1210600 | 10/1970 | United Kingdom | 200/144 B |
| 2174843 | 11/1986 | United Kingdom | 200/144 B |

*Primary Examiner*—Robert S. Macon

*Attorney, Agent, or Firm*—Leydig, Voit & Mayer

[57] ABSTRACT

An electrode structure for a vacuum circuit breaker having a pair of separable spiral-formed electrodes includes an electrode rod, a contact fixed to the electrode rod, and a plurality of arc runners extending outward from the electrode rod in the radial direction thereof in a spiral fashion, each of the arc runners having an arc runner surface which are separated from adjacent ones by first channels. Each of the arc runner surfaces of the arc runners is provided with at least one second channel. The second channel is formed separately from the first channels so as to draw a leg of an electric arc on the first channels to the second channel.

4 Claims, 3 Drawing Sheets

ELECTRODE STRUCTURE FOR VACUUM CIRCUIT BREAKERcl BACKGROUND OF THE INVENTION

1. Field of the Invention

The present invention relates to the structure of a spiral-formed or windmill type electrode capable of improving performance of a vacuum circuit breaker utilizing this electrode structure.

2. Description of the Prior Art

A known spiral-formed electrode structure is disclosed in, for example, the specification of Japanese patent Laid-Open No. 30174/1980. FIGS. 1 and 2 are plan views of respective fixed movable and fixed electrodes. The fixed electrode is coiling to the right when viewed from its front, while the movable electrode is coiling to the left. The fixed and movable electrodes have contacts 1 and 1*a* which can be brought into contact with and separated from each other, arc runners 2 and 2*a*, spiral channels 4 and 4*a* terminated at the corresponding contacts 1 and 1*a* and separating the arc runners 2 and 2*a*. Each arc runner 2 or 2*a* is in contact with the peripheral portion of the corresponding electrode at its distal end 3 or 3*a*. An arbitrary number of arc runner is employed. Each electrode is integrally formed of an alloy which contains, for example, Cu-Bi or Cu-Cr.

The operation of the spiral-formed electrodes shown in FIGS. 1 and 2 will now be described. Note that the vacuum circuit breaker having this electrode structure is capable of breaking an alternating short-circuit current of 12.5 to 50 kA. First, an arc is drawn on the contacts 1 and la as the pair of electrodes start to open. As the time elaspes from when the electrodes were parted, the arc extending between the electrodes moves from between the contacts 1 and 1*a* to between the respective arc runners 2 and 2*a*, and then to between the distal ends 3 and 3*a* of the respective arc runners. During this time, a magnetic field is generated in the space between the electrodes in the radial direction thereof, owing to the characteristics of the spiral-formed electrode structure. The direction in which the magnetic field is formed is perpendicular to the direction in which the arc is drawn, so this magnetic field generated is called a transverse magnetic field. Movement of the arc on the electrodes is accelerated by the drive effect by the transverse magnetic field.

In the known spiral-formed electrodes, when an arc current reaches several kA or above, a plurality of cathodes of the arcs are focused, thus making a focusing arc mode. In the focusing arc mode, the current density is locally increased, increasing the arc voltage to 100 V or above and thereby increasing the magnetic drive effect by the transverse magnetic field. Thus, the spiral-formed electrodes are very effective in breaking the rated short-circuit current of a vacuum circuit breaker.

When an excessive amount of short-circuit current is to be interrupted, however, the above-described magnetic drive effect becomes undesirable. Excessive current causes the cathode of the arc reach each of the arc runner distal ends 3 or 3*a* before the short-circuit current is discharged to zero, allowing negative charges to stay and accumulate there. As a result, an excessive amount of heat :s generated at each of the arc runner distal ends 3*a* or 3 of the electrode (at an anode side) which faces the electrode on which the cathode of the arc is formed. This may lead to a breaking failure in which the anode is abnormally melted. If the damaged electrode is observed later, it will become clear that the degree of damage or melting is the largest at each of the arc runner distal ends 3*a* or 3, the second largest at a portion of each of the arc runners 2*a* or 2 which is located near the corresponding spiral channel 4*a* or 4, and the smallest at the contact 1*a* or 1. It will also become clear that a portion of each of the arc runners 2*a* or 2 which is separated from the corresponding spiral channel 4*a* or 4 is not damaged or melted much, or not at all. This experiment or observation leads to a conclusion that in the known spiral-formed electrodes that breaking failure often occurred without utilizing 100% of the total areas of the opposing electrodes.

The failure of breaking an excessive amount of short-circuit current has been described above. A breaking failure also occurs after the rated short-circuit current has been interrupted a large number of times in a test so that the life of the electrodes has come near the end. In this case, the examination of the electrodes after the test also reveals that the electrode is often damaged in a similar manner to the case of excessive short-circuiting where portion of each of the arc runners 2*a* or 2 which is separated from the corresponding spiral channel 4*a* or 4 is less damaged or melted.

Generally, the potential difference is the largest at the peripheral portions of the electrodes when the electrodes are fully parted. After the arc runner distal ends have been abnormally melted, irregularity of the distal ends increases, further increasing the potentional difference at the peripheral portions up to a point at which they cannot withstand a dynamic withstand voltage generated immediately after the short-circuit current has been reduced to zero and thus fail to break the short-circuit current.

In the known spiral type electrodes, the total areas of the electrodes cannot be utilized effectively to break a short-circuit current. Therefore, the electrode must be made slightly larger than required, so as to break a predetermined rated short-circuit current. As a result, it has been difficult to provide a small electrode and hence a small vacuum vessel and thereby to produce an economical vacuum circuit-breaker.

SUMMARY OF THE INVENTION

Accordingly, an object of the present invention is to provide a vacuum circuit-breaker which can solve the problem of an non-uniform damage of the above-described spiral-formed electrode. Another object of the present invention is to provide a vacuum circuit-breaker capable of preventing abnormal melting of the peripheral portions of the electrodes, such as the arc runner distal ends, having the largest potential difference, by effectively utilizing the total areas of the opposing electrodes, and a prolonged life owing to the stable dynamic withstand voltage. A still another object of the present invention is to provide a vacuum circuit-breaker which is smaller in size and inexpensive than the conventional one.

To this end, the present invention provides a spiral-formed electrode structure for a vacuum circuit-breaker which has new second channels in addition to known spiral channels (first channels) which define arc runners. At locations which are positioned at the same distance from the axis of the electrode in the radial direction thereof, the radius of curvature (r2) of the edge portion of each of the second channels is smaller than that (rl) of each of the first channels, and the depth (d2) of each of the second channels is smaller than that (dl) of each of the first channels. Each second channel is provided at least in the arc runners of the spiral-formed electrode. Preferably, it is located substantially the same distance apart throughout with respect to and separately from the corresponding first channel. In the vicinity of the peripheral portion of the electrode, it may be located substantially the same distance apart throughout with respect to the outer peripheral circle and is separate from the arc runner.

At locations which are positioned at the same distance from the electrode in the radial direction thereof, since the radius of curvature of the edge portion of each of the second channels is smaller than that of the first channel (although the second channel is shallower than the first channel), the potential difference (E2) at the edge portion of each of the second channels can be made larger than that (El) of the first channel, so that the arc generated along the edge portion of each of the known first channels can be moved toward the edge portion of each of the second channels. The arc generated at the edge portion of each of the second channels is focused at a higher degree, and can be magnetically driven more effectively than that at the first channel.

In addition, since the depth of each of the second channels is smaller than that of the first channel, the heat capacity of each of the second channels is larger than that of the first channel. Therefore, the temperature of the second channels is not raised as high as that of the first channels, reducing the degree of damage caused to the electrode.

DESCRIPTION OF THE PREFERRED EMBODIMENTS

Figure 2:
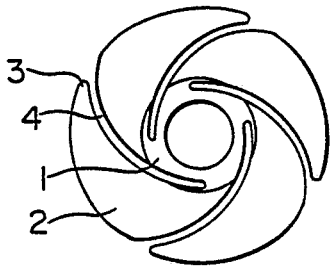
FIG. 2 PRIOR ART
FIG. 2 is a plan view of the other of the spiral-formed electrodes for the vacuum circuit-breaker.
Figure 3:
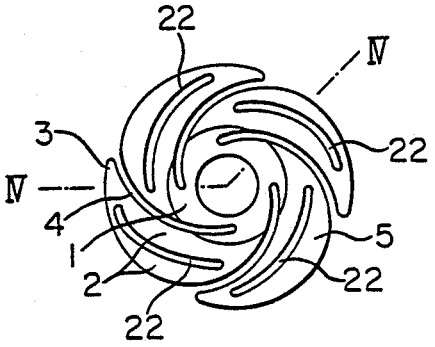
FIG. 3 is a plan view of a spiral-formed electrode structure for the vacuum circuit-breaker according to the present invention.
Figure 4:
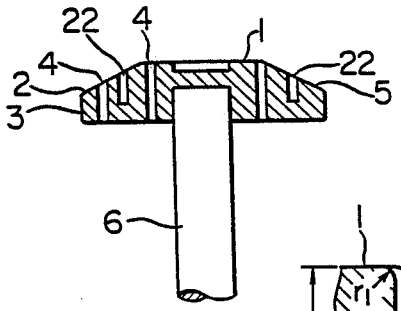
FIG. 4 is a section taken along the line IV—IV of FIG. 3.
Figure 5:
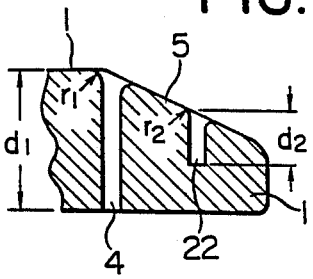
FIG. 5 is an enlarged cross-sectional view of part of the spiral-formed electrode, showing first and second channels shown in FIG. 4 in detail.

Preferred embodiments of the present invention will be hereinunder described in detail. FIGS. 3 and 4 are plan and sectional side views of one of a pair of electrodes, respectively. The electrode has a contact 1, arc runners 2, arc runner distal ends 3, and spiral channels 4 (first channels) which correspond to those of the known electrode shown in FIGS. 1 and 2 and are therefore indicated by the same reference numerals. The electrode has an arc runner surface 5, an electrode rod 6, and second channels 22, the second channels being not provided with the known electrode. As shown in FIG. 5, each of the first and second channels are formed such that a radius of curvature rl of the edge portion of each of the first channels is larger than a radius of curvature r2 of the edge portion of each of the second channels and that a depth dl of each of the first channels is larger than a depth d2 of each of the second channels.

In an embodiment shown in FIGS. 3 and 4, electrodes formed of Cu-Bi and Cu-Cr type alloys were employed to form vacuum circuit-breakers for 7.2 kV–40 kA and 12 kV–25 kA, respectively. Short-circuit breaking test (which conforms to JEC—No. 4) was conducted on each vacuum circuit-breaker, and withstand voltage test was carried out on each vacuum circuit-breaker before and after the short-circuit breaking test was done. Afterwards, the conditions of damage and melting of each electrode were observed. Vacuum circuit-breakers having conventional spiral-formed electrodes which have the same size as those in this embodiment but have no second channels were manufactured for comparison tests.

Table 1 shows the results of the short-circuit breaking tests. As can be seen from the table, the electrode structures according to the present invention which are shown in FIGS. 3 and 4 each exhibited a shorter average arcing time and a reduced arc voltage than those of the known electrodes shown in FIGS. 1 and 2. In each electrode structure according to the present invention, the number of times at which the electrodes successfully have interrupted the short-circuit current until they failed to do so increased greatly. Also, the static withstand voltage obtained after the short-circuit breaking test was done was slightly larger in the electrode structure according to the present invention.

As is clear from the observation of the electrode surfaces which was made after the test, the electrodes according to the present invention each traced of the arc generated in and along each of the second channels, and were substantially uniformly damaged over the whole electrode surfaces (over the entire areas). On the other hand, the arc runner distal ends of the known electrodes were extremely melted.

TABLE 1

| | | Short Circuit Breaking Test (JEC No. 4) | | | | | Withstand Voltage Test | | |
|---|---|---|---|---|---|---|---|---|---|
| Electrode Structure | Electrode diameter | Voltage kV | Current kA | Number of Times Times | Average Arcing Time ∞ | Arc Voltage V | Prior to The Test kV | After the Test kV | Observation of Tested Electrode |
| Embodiment according | D1 | 12 | 25 | 11 | 1.0 | 120 | 35 | 35 | The edge portions of each of the |
| | | | | Breakage occurred | | | Good | Good | |

TABLE 1-continued

Figure 1:
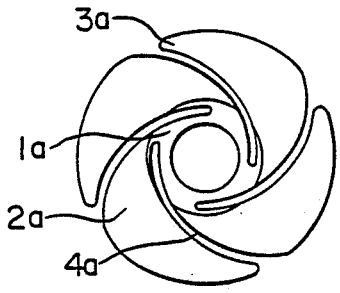
FIG. 1 PRIOR ART
FIG. 1 is a plan view of one of a pair of spiral-formed electrodes for a known vacuum circuit-breaker.

| Electrode Structure | Electrode diameter | Short Circuit Breaking Test (JEC No. 4) Voltage kV | Current kA | Number of Times | Average Arcing Time | Arc Voltage V | Withstand Voltage Test Prior to The Test kV | After the Test kV | Observation of Tested Electrode |
|---|---|---|---|---|---|---|---|---|---|
| to this invention shown in FIG. 3 | | | | (Breakage occurred 10 times and failed to occur the 11th time.) | | | | | second and the first channels have been melted uniformly by the same degree. |
| Known type shown in FIG. 1 | D1 | 12 | 25 | 4 | 1.3 | 150 | 35 Good | 24 | The arc runner distal ends and the contact have been melted to a large extent. |
| | | | | (Breakage Occurred 3 times and failed to occur the 4th time.) | | | | | |
| Embodiment according to this invention, shown in FIG. 3 | D2 | 7.2 | 40 | 10 | 1.1 | 170 | 22 Good | 22 Good | The edge portion of each of the second channels have been melted greatly. The edge portion of each of the first channels and the contact have been melted. |
| | | | | (Breakage Occurred 9 times and failed to occur the 10th time.) | | | | | |
| Known type shown in FIG. 1 | D2 | 7.2 | 40 | 5 | 1.5 | 200 | 22 Good | 16 | Each of the runner distal ends, the edge portion of each of the first channels, and the contact have been melted by a large degree. |
| | | | | (Breakage occurred 4 times and failed to occur the 5th time.) | | | | | |

Figure 6:
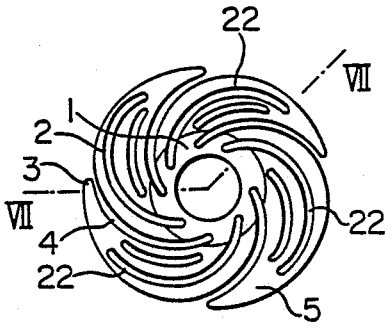
FIG. 6 is a plan view of the spiral-formed electrode structure, showing a second embodiment of the present invention.
Figure 8:
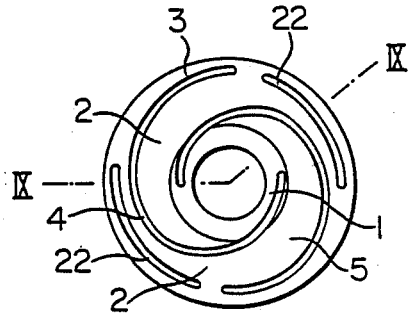
FIG. 8 is a plan view of the spiral-formed electrode structure, showing a third embodiment of the present invention.
Figure 7:
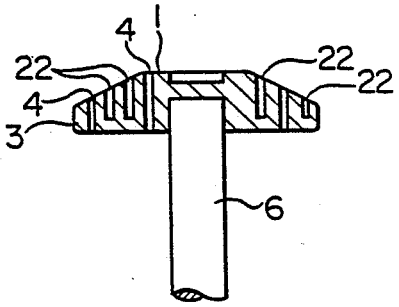
FIG. 7 is a section taken along the line of VII—VII of FIG. 6.
Figure 9:
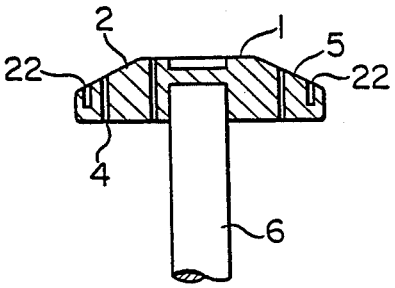
FIG. 9 is a section taken along the line of IX—IX of FIG. 8.

In the embodiment shown in FIGS. 3 to 5, the number of second channels was the same as that of the first channels. If the width of each of the arc runners in the electrode is wide, two or more of the second channels may be provided in each arc runner, as shown in FIGS. 6 and 7. In that case, the same effect is ensured even when the second channels are formed in such a manner that they extend over the contact 1 and the corresponding arc runner 2. In the embodiment shown in FIGS. 3 to 5, rl was larger than r2, and dl was larger than d2. However, the channels may be formed in such a manner that dl $\simeq$ d2, in the vicinity of the peripheral circle of the electrode so that the heat capacity of a portion of each of the second channels which is located near the peripheral circle of the electrode is close to that of the corresponding arc runner distal end 3. In this way, the total areas of the electrodes can be utilized more effectively when a short-circuit current is to be interrupted.

In addition, in the embodiment shown in FIGS. 3 to 5, the second channel was located substantially the same distance apart throughout with respect to the first channel in each arc runner. However, the total areas of the electrodes can be utilized far more effectively, if each second channel is formed parallel to the outer peripheral circle in the vicinity of the peripheral portion of the electrode.

Figure 10:
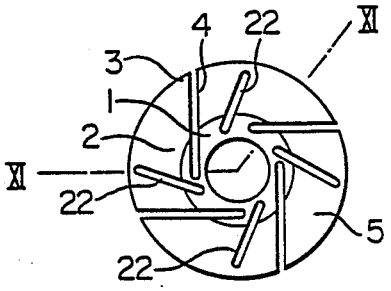
FIG. 10 is a plan view of the spiral-formed electrode, showing a fourth embodiment of the present invention.
Figure 11:
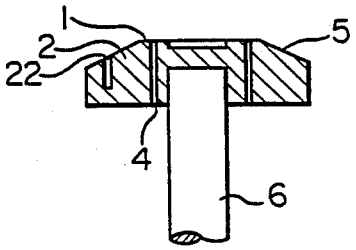
FIG. 11 is a section taken along the line of XI—XI of FIG. 10.

However, each second channel must not be provided parallel to the outer peripheral circle in the vicinity of the contact 1 of the spiral electrode, the second channel must not be brought into contact with the first channel, or the first and second channels must not cross each other. If the second channel is formed in the manner described above, an arc tends to stay in the second channel, melting the electrode. In other word, it is necessary for each second channel to be provided separately from the first channel. Also it is preferable for each second channel to be positioned at a location on each of the opposing surfaces of the electrodes which has a large heat capacity. The second channel 22 may be formed in the manner shown in FIGS. 10 and 11.

As will be understood from the foregoing description, since each of the spiral-formed electrodes in a vacuum circuit-breaker has the second channels in addition to the first channels which separate the arc runners, the substantially all the areas of the opposing surfaces of the electrodes could be effectively utilized to break a short-circuit current. The electrodes were less damaged, breaking failure owing to the abnormal melting of the distal ends of the arc runners was eliminated, and the electrode life was prolonged. As a result, the size of the electrode can be made smaller than that of the known electrode to break a predetermined rated short-circuit current. This can reduce the size of the vacuum vessel and the production cost of the vacuum circuit-breaker.

What is claimed is:

1. An electrode structure for a vacuum circuit breaker having a pair of separable spiral-formed electrodes, said electrode structure including an electrode rod, a contact fixed to said electrode rod, and a plurality of arc runners extending radially outward from said electrode rod in a spiral fashion, each of said arc runners having an arc surface which is separated from arc surfaces of adjacent arc runners by first channels and at least one second channel separate from said first channels and drawing a leg of an electric arc on each of said first channels onto said second channel, said first channels having a first depth and each of said second channels having a depth which is smaller than the depth of said first channels at radial locations which are the same distance from said electrode rod.

2. An electrode structure for a vacuum circuit breaker according to claim 1 wherein the radius of curvature of an edge portion of each of said second channels is smaller that of said first channel at locations which are in the same radial direction from said electrode rod.

3. An electrode structure for a vacuum circuit breaker according to claim 1 wherein each of said second channels is located substantially the same distance apart throughout with respect to and separately from said first channel.

4. An electrode structure for a vacuum circuit breaker according to claim 1 wherein said arc runners are connected to each other at distal ends to provide a continuous electrode peripheral portion, and each of said second channels is located substantially the same distance apart throughout with respect to a peripheral edge in said peripheral portion.

* * * * *